United States Patent [19]

Bonato

[11] Patent Number: 5,055,021

[45] Date of Patent: Oct. 8, 1991

[54] INTERMEDIATE ANCHOR FOR CENTRIFUGAL CONCRETE MOLD FOR PRODUCING RING-SHAPED PRESTRESSED CONCRETE BODIES

[76] Inventor: Emil Bonato, Grenzweg 8, 5330 Königswinter 41, Fed. Rep. of Germany

[21] Appl. No.: 558,830

[22] Filed: Jul. 27, 1990

[30] Foreign Application Priority Data

May 11, 1990 [DE] Fed. Rep. of Germany ..... 4015093

[51] Int. Cl.[5] ..... B28B 21/60; B28B 23/08

[52] U.S. Cl. ..... 425/111; 52/223 L; 52/699; 249/91; 249/184; 264/228

[58] Field of Search ..... 425/111; 264/228, 229; 249/91, 93, 184; 52/223 R, 223 L, 699, 700, 701, 713, 714

[56] References Cited

U.S. PATENT DOCUMENTS

| | | | |
|---|---|---|---|
| 2,080,074 | 5/1937 | Freyssinet et al. | 425/111 |
| 2,950,517 | 8/1960 | Brickman | 264/228 |
| 3,738,786 | 6/1973 | Van Buren | 425/111 |

FOREIGN PATENT DOCUMENTS

| | | | |
|---|---|---|---|
| 612907 | 1/1961 | Canada | 425/111 |
| 214420 | 3/1987 | European Pat. Off. | 264/228 |
| 2035896 | 12/1970 | France . | |
| 458450 | 3/1975 | U.S.S.R. | 425/111 |
| 653368 | 3/1979 | U.S.S.R. | 264/228 |
| 903542 | 2/1982 | U.S.S.R. | 264/228 |
| 1818967 | 2/1966 | United Kingdom . | |
| 1504905 | 3/1978 | United Kingdom | 425/111 |

*Primary Examiner*—James C. Housel
*Attorney, Agent, or Firm*—Michael J. Striker

[57] ABSTRACT

The intermediate anchor includes an abutment body for an end of an anchoring element mounted on an end of a pretensioning element, the abutment body is supportable on an inner side of a wall of the centrifugal concrete mold and mountable on the inner wall. At least one anchor bolt extendable through the wall of the centrifugal concrete mold in a sealed manner mounts the abutment body. The abutment body has a conical recess extending transversely to the anchor bolt for receiving the anchoring element of the pretensioning element. A wedge-shaped projecting piece is releasably mounted on the abutment body and engages the tensioning element in a fork-shaped manner near the anchoring element. The projecting piece is releasable after removal of the pretensioned concrete body from the centrifugal concrete mold and before removal of the abutment body from the concrete body so as to release a portion of the pretensioning element near the anchoring element for separating by a separating device.

13 Claims, 5 Drawing Sheets

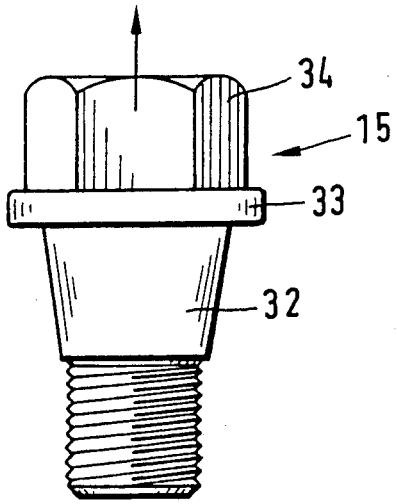
FIG. 9
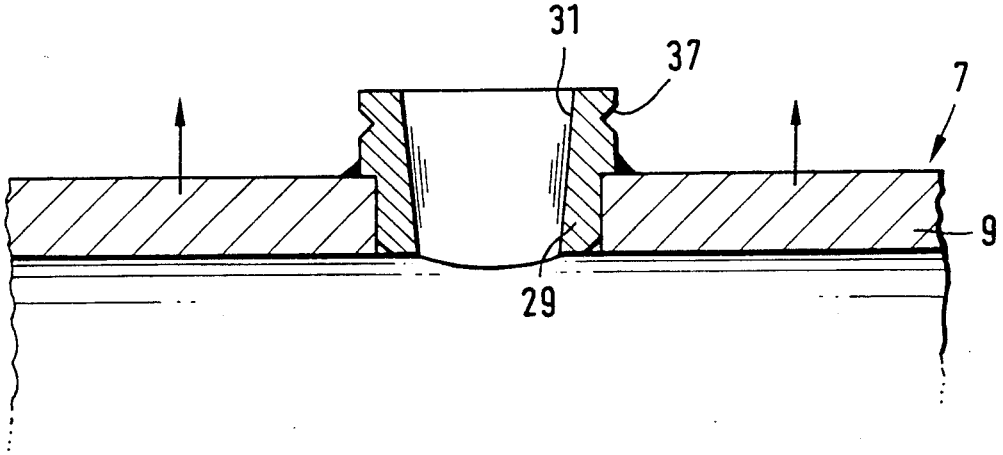
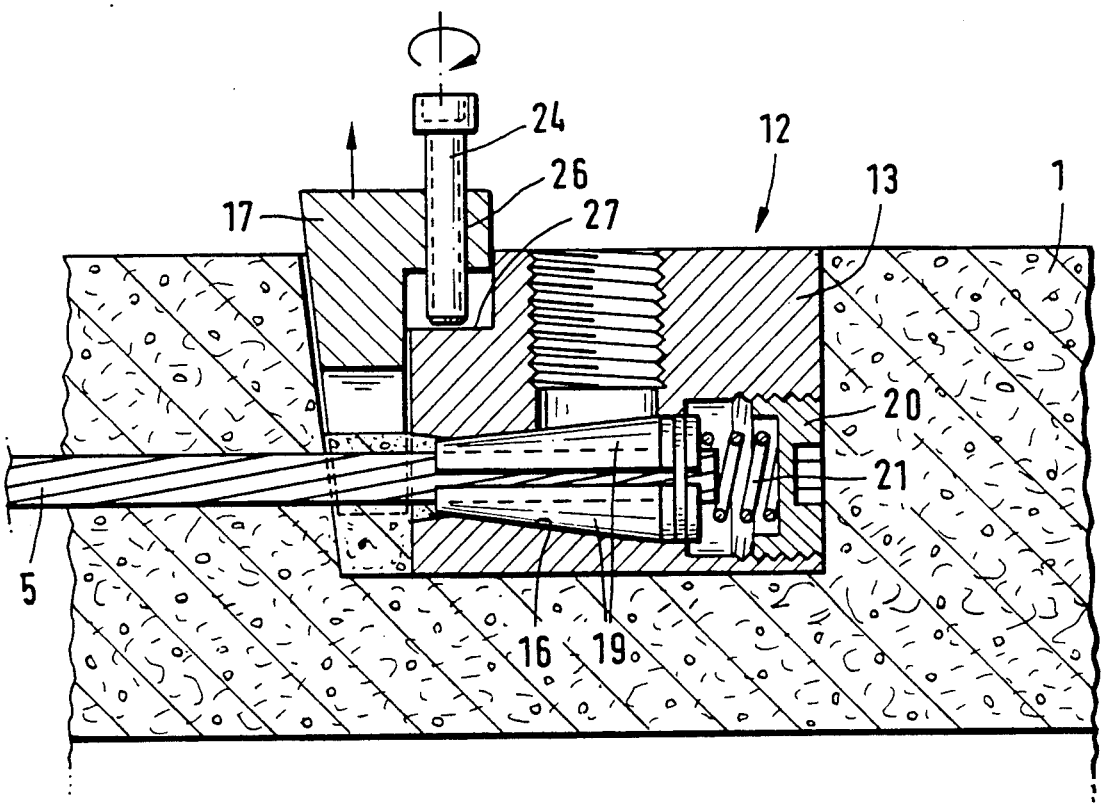

INTERMEDIATE ANCHOR FOR CENTRIFUGAL CONCRETE MOLD FOR PRODUCING RING-SHAPED PRESTRESSED CONCRETE BODIES

BACKGROUND OF THE INVENTION

The present invention relates to an intermediate anchor for centrifugal concrete molds composed of tubular semi-shells with end clamping heads, for producing conically extending tubular pre-stressed concrete bodies of significant length, such as for example, prestressed concrete masts for high voltage power lines, light poles for deep bowl reflectors and the like.

During producing of conically extending tubular pre-stressed concrete masts it is known for example from U.S. Pat. No. 3,738,786, to extend only a part of the pretensioning wires or pretensioning strands through the whole length of the mast, while the remaining pretensioning wires or pretensioning masts extend from the foot of the mast only over a portion of the mast length. These features are required in the pretensioned concrete mass of a great length of for example 30 meters or more so that the pressure which is applied from the pretensioning wires on the upwardly conically reducing pretensioned concrete body with reducing concrete crosssection, does not exceed a permissible maximum value per cross-sectional surface. Moreover, it is necessary to take care that the pretensioning wires or pretensioning strands in the conically reducing upper mast portion are not located too close to one another therefore the concrete between the wires or strands can be uniformly distributed. Due to the shortened pretensioning wires or pretensioning strands also a significant material saving in the upper mast region is achieved.

For producing such prestressed concrete masts, the used centrifugal concrete molds conventionally composed of two conically extending semi-shells must be provided with several intermediate anchors at corresponding distances from the foot-side end for the mold rotatable about a horizontal axis. Thereby the shortened pretensioning wires or pretensioning strands and the throughgoing pretensioning wires or pretensioning strands can be held under the required pretensioning.

Since such shortened prestressing wires or prestressing strands are needed as a rule only for the conically extending pretensioned concrete mass of a great length, the pretensioning wires or pretensioning strands conventionally have a diameter of approximately 8 mm or more. Pretensioning wires or pretensioning strands with such diameters cannot be bent manually, and moreover special bending tools are needed for this purpose which has been shown to be disadvantageous for the treatment of pretensioning wires or pretensioning strands.

An intermediate anchor in accordance with an especially simple embodiment is known, which is formed as a substantially circular segment-shaped rounded anchoring plate. The anchoring plate extends through a longitudinal slot in the wall of both semi-shells of the centrifugal concrete mold provided with a longitudinal groove or depression on their circular edge for inserting bent ends of a shortened pretensioning wire. The outwardly guided end of the pretensioning wire is provided with an anchoring element supported outside on the anchoring plate. The anchoring plate is held on the wall of the centrifugal concrete mold by flange parts extending at both sides of the longitudinal slot and secured by two mounting pins extending through the anchoring plate and both parallel flange parts.

Such an intermediate anchor which on first flange is simple, possesses however, some disadvantages since the shortened pretensioning wires or pretensioning strands must be bent for mounting on the respective anchoring plates. Only for the anchoring on the lower semi-cell of the centrifugal concrete mold these tensioning wires can be preliminarily cut to such a length as required for the anchoring of the intermediate anchor up to the anchoring of the foot-side clamping head of the centrifugal concrete mold but not in the upper part of the centrifugal concrete mold. There the shortened pretensioning wires must have a significant length surplus so that the foreclosing of the upper mold they can be guided from the inner side to the intermediate anchor locations outwardly by hand. Since during the fast binding of the concrete mixture for the closing of the centrifugal concrete mold and the subsequent centrifugal process only a relatively short time is available, the preparation and mounting works must take a lot of effort resulting in high manufacturing costs.

A further disadvantage is that the longitudinal slots provided for the mounting of the anchoring plates on the intermediate locations between the outwardly directed parallel flange parts can be sealed only in imperfect manner. These imperfect sealings lead during the centrifugal process to discharge of cement mass through the slots provided near the anchor plates and leading the pretensioning wire ends outwardly under the action of the centrifugal forces. The discharge substantially contaminates the whole centrifugal concrete installation and due to fast binding cannot be practically removed without residues. Such untighteness of the passages for the shortened pretensioning wires or pretensioning strands can also lead to an imperfect binding of the accelerated concrete in these intermediate anchor regions.

Similar differences occur in another intermediate anchor, in which the pretensioning wire ends in the region of the intermediate anchor are not guided through the wall of the centrifugal concrete mold outwardly but instead anchored in the interior of the centrifugal concrete mold on the anchoring plates. The anchoring plates similarly to the above described intermediate anchoring, are also mounted in the longitudinal slots on the centrifugal concrete mold between the outwardly extending parallel flange parts.

In the intermediate anchor in accordance with a further embodiment shown in FIGS. 8, 9 of U.S. Pat. No. 3,738,786, the anchoring plate extending perpendicularly into the hollow chamber of the centrifugal concrete mold must serve as an abutment for a semi-circular holding plate with a peripheral groove for inserting the pretensioning wire or the pretensioning strand with an end-side loop. The formation of the pretensioning wire or the pretensioning strand with such a loop requires for the pretensioning wires or pretensioning strands with diameters of at least 1–2 inches or more than 12 mm, a significant bending expense for preparation of such pretensioning wires or pretensioning strands. These problems are so great that they are not used in practice for economical reasons.

Finally, a further embodiment of the intermediate anchor shown in FIGS. 10 and 11 of U.S. Pat. No. 3,738,786 deals with the anchoring plate which extends inwardly through a longitudinal slot of the centrifugal concrete mold as in the previous embodiments and secured by two pins on the flanges which extend parallel to it. In this embodiment the anchoring plate engages the pretensioning wire or the pretensioning strand in a fork-shaped manner and has a perpendicular abutment surface for a special clamping element. The clamping element is mounted on the end of the pretensioning wire or the pretensioning strand inside the centrifugal concrete mold and secured the pretensioning wire or the pretensioning strand on the anchoring plate as an abutment body.

In this embodiment an intermediate anchoring possesses the same above mentioned sealing difficulties. Moreover, the special anchoring required for the shortened pretensioning wires or pretensioning strands and abutting against the anchoring plate of the intermediate anchor is lost after the removal of the pretensioned concrete body, since the anchoring plate can be removed from the recess in the wall of the pretensioned concrete body, while, however the clamping anchoring which in addition to the recess is fixedly anchored in the wall of the pretensioned concrete body, cannot be removed.

SUMMARY OF THE INVENTION

Accordingly, it is an object of the present invention to provide a intermediate anchor for producing of conically extending tubular pretensioned concrete bodies in a centrifugal concrete process, which avoids the disadvantages of the prior art.

More particularly, it is an object of the present invention to provide an intermediate anchor for producing conically extending conical prestressed concrete bodies in accordance with a centrifugal concrete process which is formed so that on the one hand at the locations where the intermediate anchors are arranged in the centrifugal concrete mold a complete sealing against escape of cement mass is provided, and on the other hand, the whole intermediate anchor with corresponding special anchoring for the inner end of the shortened pretensioning wires or pretensioning strands can be completely released from the wall of the produced pretensioned concrete body in a simple and reliable manner without being destroyed.

In keeping with these objects and with others which will become apparent hereinafter, one feature of the present invention resides, briefly stated, in an intermediate anchor in which the abutment body is arranged to abut against an inner side of the wall of a centrifugal concrete mold and mounted by at least one anchoring bolt sealingly extending through the wall of the centrifugal concrete mold, an abutment body has a conical recess extending transversely to the anchoring bolt for receiving anchoring elements for the pretensioning wire or the pretensioning strand, and a wedge-shaped projecting piece is releasably mounted on the abutment body and engages the pretensioning wire or the pretensioning strand near the anchoring elements in a fork-shaped manner wherein the projecting piece is releasable after the removal of the prestressed concrete body from the centrifugal concrete mold and before the removal of the abutment body from the concrete body, and a portion of the pretensioning wire or the pretensioning strand near the anchoring elements can be released for separation by a welding burner or a different suitable separating device.

Since the abutment body abuts against the inner side of the wall of the centrifugal concrete mold and mounted at least one anchoring bolt sealingly extending from outside through the wall of the centrifugal concrete mold and undesirable escape of the cement mass in the region of the intermediate anchor is avoided. Due to the further feature that the abutment body has a conical recess extending transverse to the anchoring bolt for receiving the anchoring element for the pretensioning wire or pretensioning strand, the anchoring element for the pretensioning wire or the pretensioning strand required on the intermediate anchors remain in the wall of the finished pretensioned concrete body. Since the anchoring elements are integrated in the abutment body of the intermediate anchor, it is guaranteed in a simple manner that these expensive special anchoring elements are removed during removal of the abutment body from the wall of the finished prestressed concrete body and will be again available for production of further such prestressed concrete bodies.

The dismantling of the abutment body, after the removal of the prestressed concrete body, from the wall of the prestressed concrete body is possible in a simple manner when the wedge-shaped projecting piece is releasably mounted on the abutment body and engages in a fork-shaped manner the pretensioning wire or the pretensioning strand near the anchoring element. After the removal of the pretensioned concrete body from the centrifugal concrete mold and before the removal of the abutment body from the concrete body, it is released as a first part of the abutment body. Therefore, a portion of the pretensioning wire or the pretensioning strand is released near the anchoring element for separation by means of a welding burner or another suitable separating device. After the separation of the pretensioning wire or the pretensioning strand, the abutment body together with the anchoring elements arranged on it can be removed from the wall of the finished pretensioned concrete body, so that the recess produced at this location can be filled with concrete.

An automatic clamping action of the anchoring elements for the pretensioning wire or the pretensioning strand arranged in the abutment body can be provided in an especially simple manner in accordance with a further feature of the present invention. More particularly, in accordance with this feature the recess for the anchoring element in the abutment body is conically reduced in the pulling direction of the pretensioning wire or the pretensioning strand, and the anchoring element is formed as a tensioning clamp with at least two or three wedge-shaped round clamping jaws to clamp the pretensioning wire or the pretensioning strand therebetween.

For avoiding penetration of the cement mass into the recess for the anchoring element on the abutment body, the conically reducing recess for the round clamping jaws in the abutment body is closed at the end side by a closing screw.

Moreover, an automatic clamping action of the anchoring element on the pretensioning wire or the pretensioning strand can be insured in accordance with a further feature of the present invention, when the round clamping jaws are located under the action of a helical pressure spring. The latter abuts against the closure screw and acts in the pulling direction of the pretensioning wire or the pretensioning strand, so that the pretensioning wire or the pretensioning strand is blockingly fixed without pulling stresses.

For the connecting the projecting piece with the abutment body, the projecting piece which engages the pretensioning wire or the pretensioning strand in a fork-shaped manner is provided with an L-shaped projecting holding web or holding flange. The latter is mounted in a correspondingly shaped upper edge recess of the abutment body by a threaded bolt in a releasable fashion. The threaded bolt extends for example parallel to the screw anchoring bolt for mounting of the abutment body on the wall of the centrifugal concrete mold and extends in a sinking manner in the projecting piece.

Simple release of the projecting piece from the wall of the finished prestressed concrete body can be achieved in accordance with a further feature of the present invention, when the mounting web of the projecting piece is provided with a threaded opening extending parallel to the opening for the threaded bolt at least two the abutment surface of the abutment body, and a releasing pin is screwed in the threaded opening for lifting the projecting piece from the abutment body. Thereby an additional tool for releasing the projecting piece from the wall of the finished prestressed concrete body is no longer needed.

For simple and reliable mounting of such inventive abutment body on the inner side of the wall of the centrifugal concrete mold, the anchoring bolt for the intermediate anchor is advantageously formed as a screw anchoring bolt. The centrifugal concrete mold in turn has ring-shaped mounting bushes at several locations, for mounting the intermediate anchor by the screw anchor bolts. The mounting bushes are completely sealingly mounted in the wall of the centrifugal concrete mold, preferably by welding.

For easy mounting and simple sealing of the mounting locations on the centrifugal concrete mold, the mounting bushes and the screw anchoring bolts have cooperating inter-engaging surfaces, in accordance with another feature of the present invention.

Moreover, the mounting bushes in the wall of the centrifugal concrete mold, which are not required for mounting the intermediate anchors, can be closed in a simple manner by closure covers. The closure covers can be provided with conical closure plugs which sealingly engage in conical openings for the screw anchoring bolts. For securing the closure covers, the mounting bushes can be provided with a ring-shaped peripheral groove for engaging by the screw thread pins extending radially inwardly from the edge of the closure cover which engages the mounting bush.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 9 is a longitudinal section through the intermediate anchor after removal of the finally centrifuged prestressed concrete body from the centrifugal concrete mold in an intermediate stage, wherein the upper mold half of the centrifugal concrete mold is removed from the prestressed concrete body and the projecting piece of the intermediate anchor is removed from the abutment body with the integrated anchoring element for the pretensioning wire or pretensioning strand;

DESCRIPTION OF THE PREFERRED EMBODIMENTS

Figure 1:
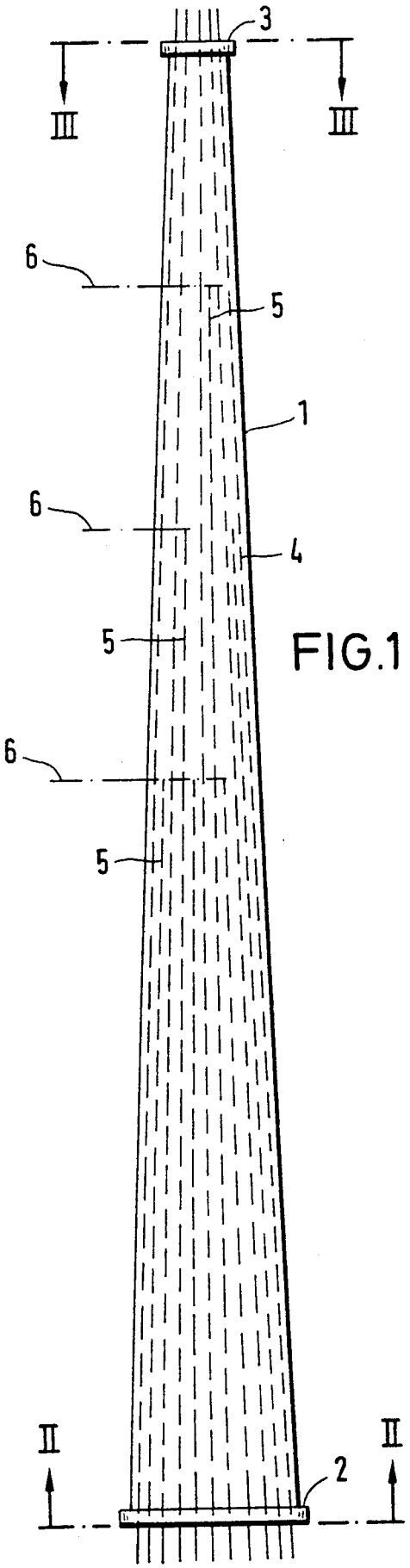
FIG. 1 is a view schematically showing the conical tubular prestressed concrete body in which some pretensioning wires or pretensioning strands extend over the whole length of the body while the other pretensioning wires or pretensioning strands extend only over a part of the length of the prestressed concrete body and end at intermediate anchoring locations.
Figure 3:
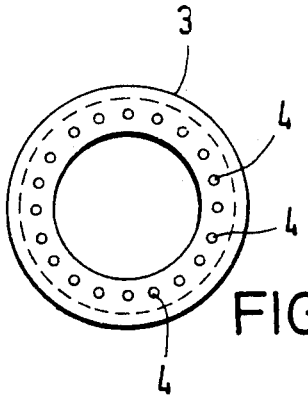
FIG. 3 is an end view of the clamping head arranged at the head-side end of the prestressed concrete body with a smaller ring section, as seen in direction of the arrow III—III in FIG. 1.
Figure 2:
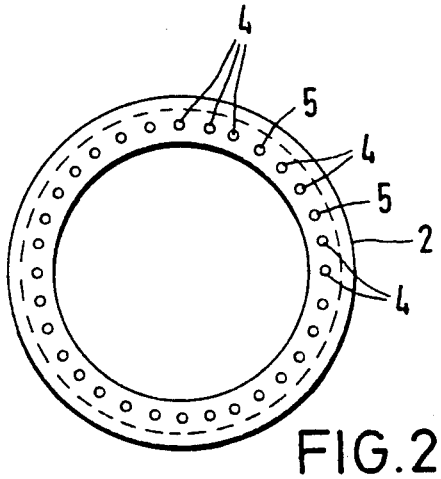
FIG. 2 is an end view of a foot-side clamping head during manufacture of such prestressed concrete body, as seen in direction of the arrow II—II in FIG. 1.

FIGS. 1, 2 and 3 show a conically extending tubular prestressed concrete body 1 of substantial length, which can be used in form of prestressed concrete masts for high voltage lines or as light mast of deep bowl reflectors and the like. A foot-side prestressed head 2 of FIG. 2 and a head-side prestressed head 3 of FIG. 3 for the prestressed concrete body 1 are shown schematically. They are used for the manufacture of such prestressed concrete bodies of great length. Only a part of for example available 32 tensioning wires 4 extend over the whole length of the prestressed concrete body 1, for example 20 tensioning wires while the remaining twelve tensioning wires 5 in groups of four tensioning wires 5 and at several intermediate anchoring locations 6 which are distributed over the length of the prestressed concrete body 1 and shown schematically in FIG. 1 by dash-dot lines.

Figure 4:
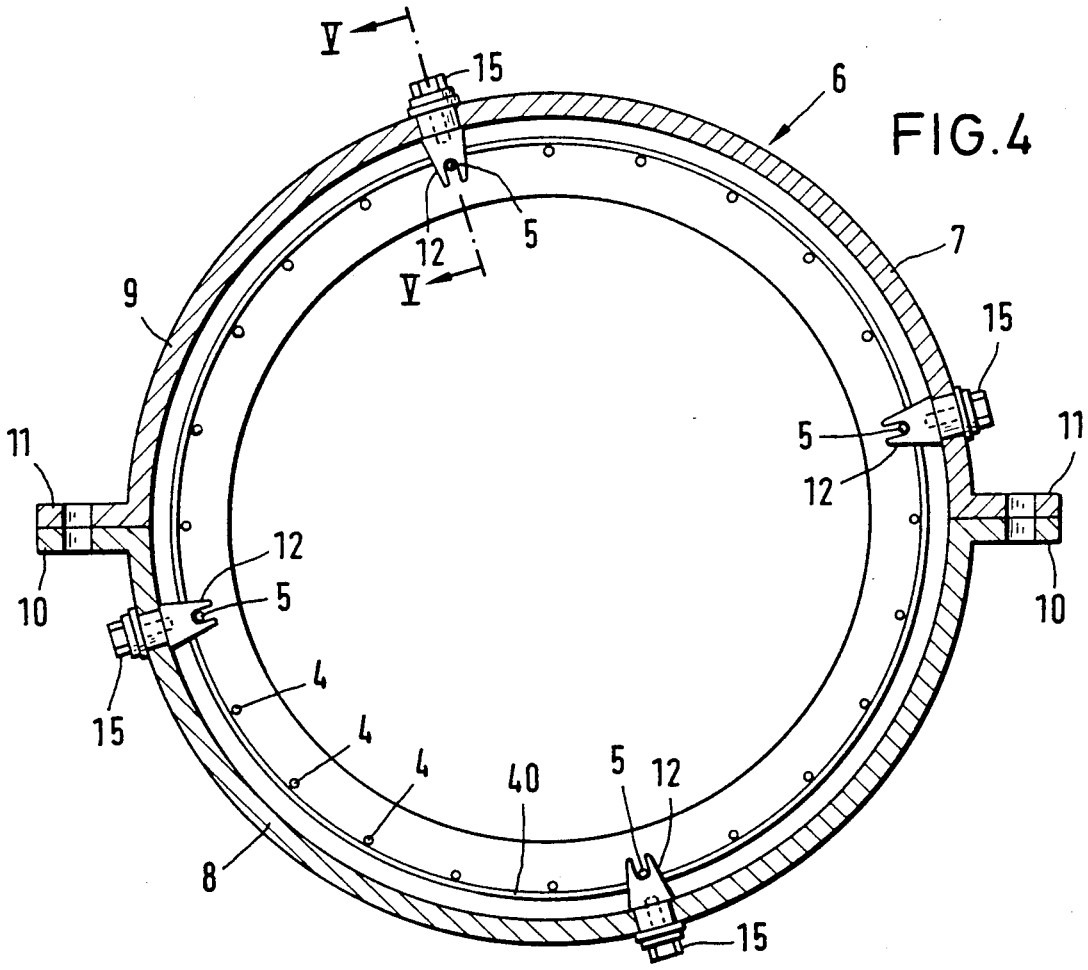
FIG. 4 is a section through a conical centrifugal concrete mold composed of two semi-shells and provided with a plurality of intermediate anchors distributed on the inner periphery of both semi-shells of the mold.

FIG. 4 shows a schematic cross-section through such an intermediate anchoring point 6 on a centrifugal concrete mold 7. It is composed of two tubular conically reducing semi-shells 8 and 9 connected with one another by longitudinal flanges 10 and 11 and associated connecting elements for a centrifugal process of producing of such tubular prestressed concrete masts of FIG. 1.

Figure 5:
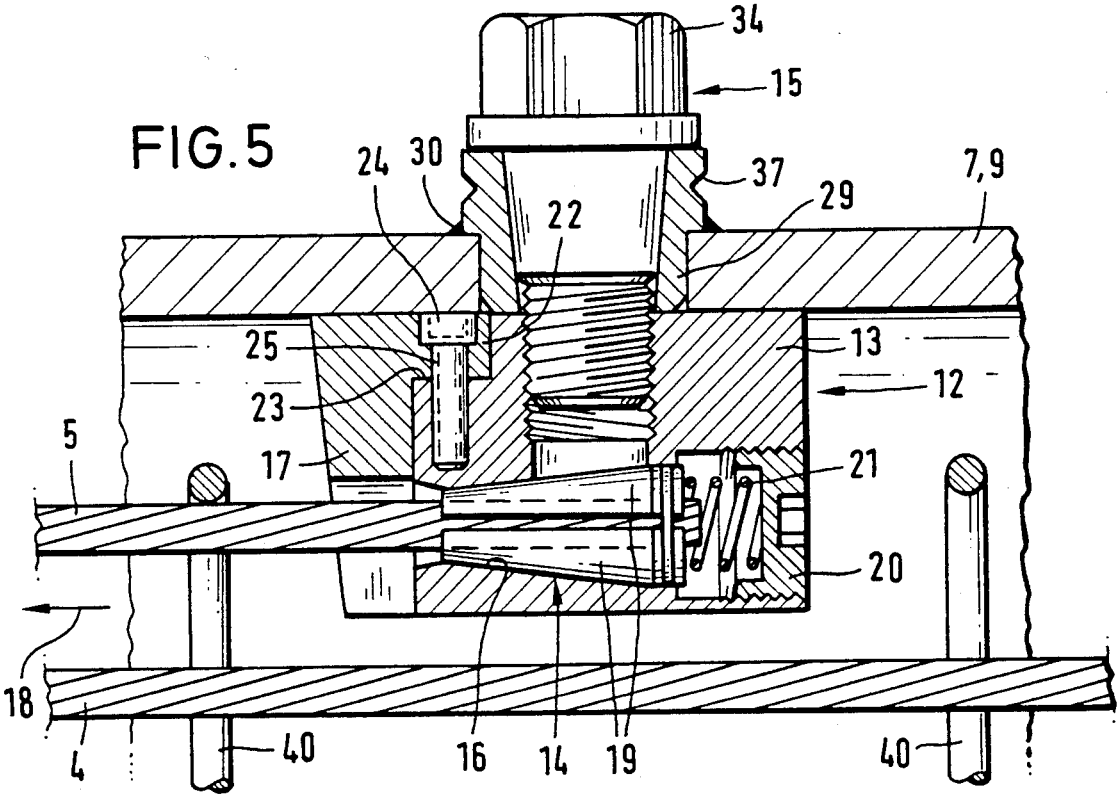
FIG. 5 is a view showing a longitudinal section through the intermediate anchor, taken along the line V—V in FIG. 4, on an enlarged scale, after providing the mold with required pretensioning wires or pretensioning strands and reinforcement before the beginning of the centrifugal process.

As can be seen from FIG. 4, at the intermediate anchoring locations 6 a plurality of intermediate anchors 12 are arranged on the inner periphery of the centrifugal concrete mold 7 at predetermined distances from one another. FIG. 5 shows a longitudinal section of such an intermediate anchor 12, when seen along the section line V—V in FIG. 4.

Each intermediate anchor 12 includes an abutment body 13 for an end of an anchoring element 14 mounted on the shortened prestressing wire or prestressing strand 5. The abutment body 13 is supported on the inner side of the wall of the centrifugal concrete mold 7 and mounted by at least one threaded anchor bolt 15. The threaded anchor bolt 15 extends from outside through the wall of the centrifugal concrete mold 7 perpendicularly to the latter and is sealed.

The abutment body 13 has a conical recess 16 which extends transversely to the threaded anchor bolt 15 and provided for receiving the anchoring elements 14 for the pretensioning wire or the pretensioning strand 5. A wedge-shaped projection piece 17 is releasably mounted on the abutment body 13 and engages one of the pretensioning wires or the pretensioning strands 5 near the anchoring elements 14 in a fork-shaped manner. The projecting piece 17 is released after the removal of the pretensioning concrete body 1 from the acceleration concrete form 7 and before the removal of the abutment body 13 from the wall of the pretensioned concrete body 1. As a result, a portion of the pretensioning wire or pretensioning strand 5 near the anchoring elements 14 is released for separating by welding burners or other suitable separating devices as shown in FIG. 9 in detail.

The recess 16 for the anchoring elements in the abutment conically reduces in a pulling direction 18 of the pretensioning wire or the pretensioning strand 5. The anchoring elements 14 are formed as tensioning clamps with at least two or three wedge-shaped round clamping jaws 19 to clamp the pretensioning wire or the pretensioning strand 5 therebetween. The conically reducing recess 16 for the round clamping jaws 19 is closed in the abutment body 13 at an end side by a closing screw 20. A helical pressure spring 21 abuts against the closing screw 20 to load the round clamping jaws 19 in the pulling direction 18 of the pretensioning wire or pretensioning strand 5 so that they blockingly clamp the pretensioning wire or the pretensioning strand 5 without pulling stresses.

Figure 6:
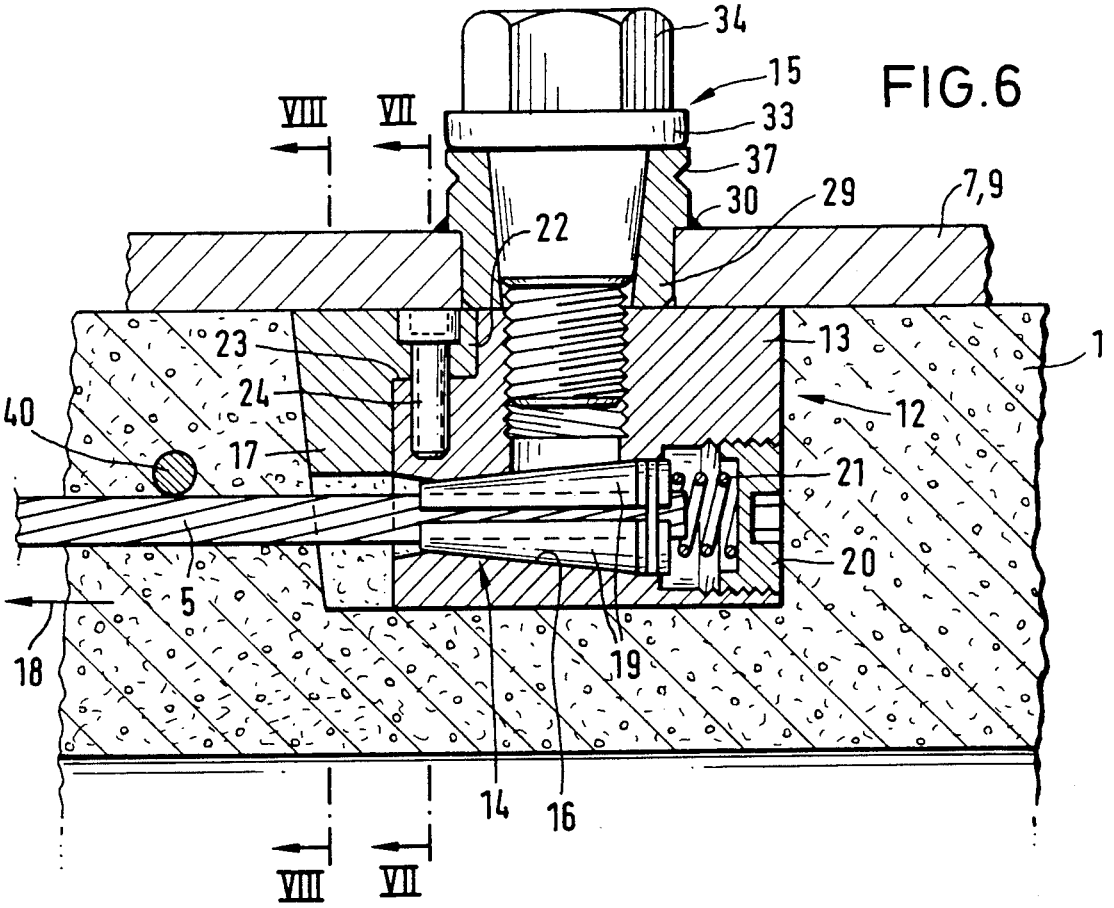
FIG. 6 is a longitudinal section corresponding to FIG. 5, through the intermediate anchor after the end of the centrifugal process.

The fork-shaped projecting piece 17 which engages the pretensioning wire or the pretensioning strand 5 has an L-shaped projecting holding web or holding flange 22 which is releasably mounted in a correspondingly shaped upper edge recess 23 of the abutment body 13 by a threaded pin 24. The threaded bolt 24 extends preferably parallel to the threaded anchoring bolt 15 for mounting of the abutment body 13 on the wall of the centrifugal concrete mold 7 and sinks with its bolt head in the projecting piece 17 so that the finally mounted abutment body 13 together with the projecting piece 19 can be mounted directly on the inner side of both semi-shells 8 and 9 of the centrifugal concrete mold 7 by the above mentioned threaded anchor bolt 15 as shown in FIGS. 5 and 6.

Figure 7:
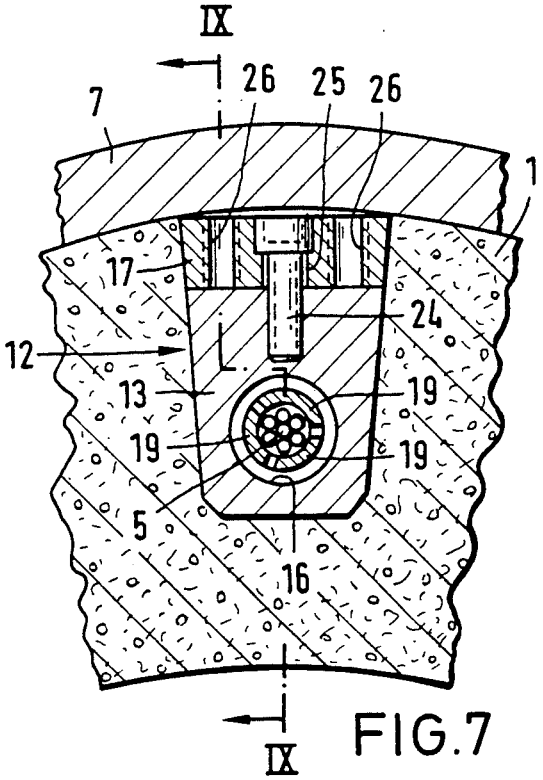
FIG. 7 is a perpendicular section through the intermediate anchor taken along the line VII—VII in FIG. 6.
Figure 8:
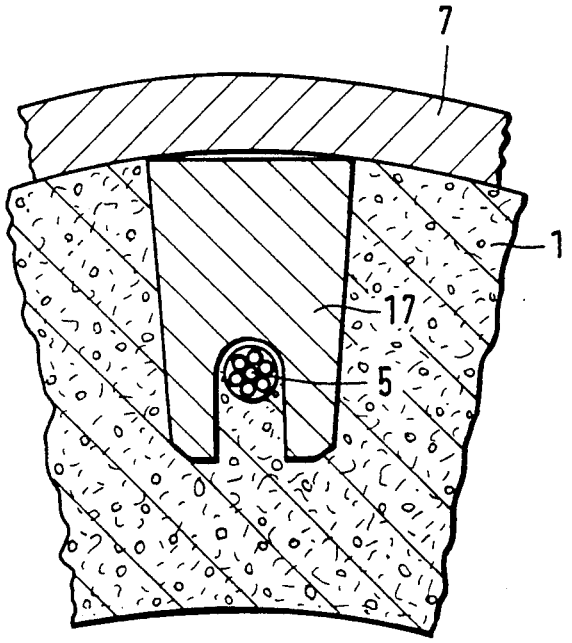
FIG. 8 is further section through the intermediate anchor taken along the line VIII—VIII in FIG. 6.
Figure 10:
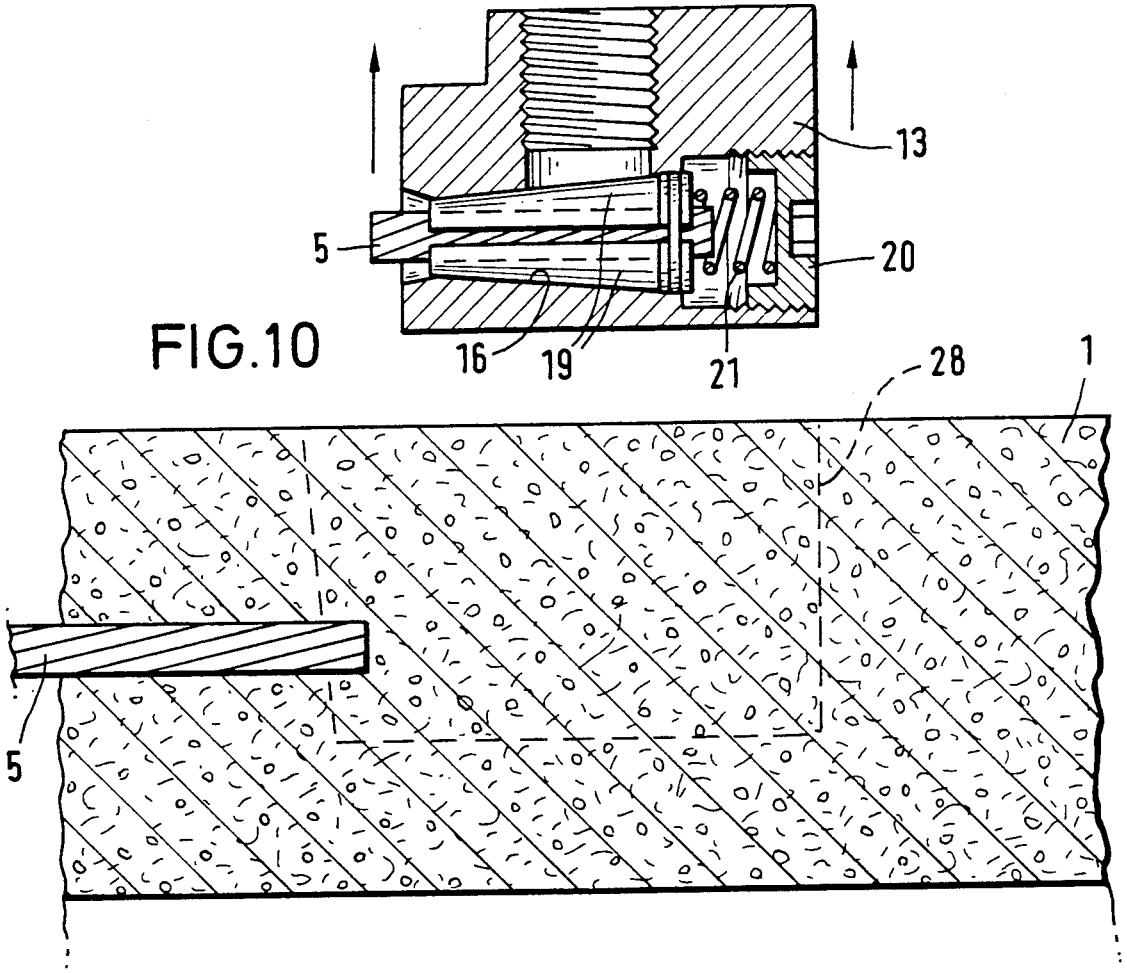
FIG. 10 is a schematic longitudinal section through a part of the finished prestressed concrete body with the intermediate anchor released from the tubular wall and the recess in the tubular wall filled.
Figure 11:
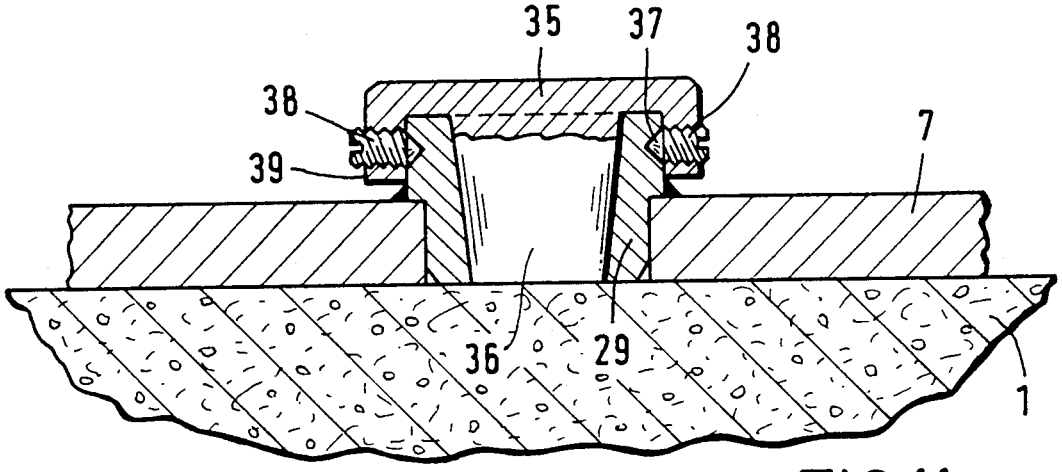
FIG. 11 is a view showing a closure cover which is arranged instead of an intermediate anchor on the mounting location on the wall of the centrifugal concrete mold.

As can be seen from FIG. 7, two further threaded openings 26 are provided on the holding web or flange 22 of the projecting piece 17 parallel to an opening 25 for the threaded bolt 24. The threaded openings 26 extend to a projection 27 located underneath on the abutment body 13, so that the threaded bolts 24 after releasing from the central opening 25 can be screwed in one of both lateral threaded openings 26. Therefore, the projecting pieces 17 after the removal of the finally accelerated pretensioned concrete body 1 can be released from the wall as shown in FIG. 9 and a part of the associated shortened pretensioning wire or the corresponding pretensioning strand 5 is released and can be cut off by a welding burner or another suitable separating device. After this, as shown in FIGS. 9 and 10, the abutment body 13 together with the round clamping jaws 19 located in it and the end piece of the pretensioning wire 5 fixed by the jaws can be released from the wall of the pretensioned concrete body 1. The recess 28 on the periphery of the pretensioned concrete body 1 can be filled concrete in a known manner.

For mounting the different intermediate anchors 12 on the inner periphery of the centrifugal concrete mold 7, it is provided with ring-shaped mounted bushes 29 at several locations. The mounting bushes correspond to the shape of the used threaded anchor bolts 15 and fixed in the wall of the centrifugal concrete mold 7 by welding, for example by a welding seam 30, in a completely sealed manner.

The mounting bushes 29 and the anchoring bolts 15 have fitting interengaging conical supporting surfaces 31 and 32. Therefore, a discharge of a cement mass on the mounting locations for the intermediate anchor 12 is reliably prevented. In addition to the above illustrated mutual metallic sealing between the threaded anchor bolt 15 and the mounting bush 20, also in some cases a sealing ring can be inserted between these parts.

The threaded anchor bolt 15 is provided with a clamping flange 33. The clamping flange sits on the mounting bush 29 at its end side and has a hexagonal head 34 for a bolt mounting with a suitable compressed air or electric screwdriver.

For closing of such mounting bushes 29 which are not used for mounting of the intermediate anchors 12, a closure cover 35 is provided. It has a conical closure plug 36 which wills a conical throughgoing opening for the threaded anchor bolt 15. The closure plug extends to the inner side of the wall of the centrifugal concrete mold 7 and forms a part of a completely smooth outer wall of the finished pretensioned concrete body 1 in the region of the mounting bushes 29.

The mounting bush 29 is provided with a ring-shaped peripheral groove 37 for mounting of the closure cover 35. Threaded pins 38 engage in the peripheral groove 37 and extend radially inwardly from an edge 39 of the closure cover 35 which engages the mounting bush 29.

For preparing such a centrifugal concrete mold 7 for producing the pretensioned concrete bodies 1 with pretensioning wires or pretensioning strands 4, 5, of which only a part extends over the whole length of the pretensioned concrete body while another part of the pretensioning wires or pretensioning strands 5 and at different intermediate anchors 12, the intermediate anchors 12 are fixed on predetermined locations on the inner side of both semi-shells 8 and 9 of the centrifugal concrete mold 7 by means of the predetermined thread anchor bolts 15. The pretensioning wires or pretensioning strands 4 which extend over the whole length of the conical pretensioned concrete body 1 are fixed on both foot-side and head-side clamping heads 2 and 3. The shortened pretensioning wires or pretensioning strands 5 are cut to such length that they reach from the foot-side clamping head 2 to the respective intermediate anchor 12. Due to the springy support of the round clamping jaws 19 provided as the anchoring elements 14 on the abutment body 13 of the intermediate anchor 12, the ends of the associated shortened pretensioning wire or pretensioning strand 5 which has been cut to a certain length can be simply inserted between the clamping jaws 19. The clamping jaws 19 due to the springy support by the helical pressure spring 21 engaging their rear side, momentarily abut efficiently against the end of the pretensioning wire or the pretensioning strand 5 and secure the same against pulling out. After all shortened pretensioning wires 5 are mounted in this manner on the associated intermediate anchors 12 and the remaining reinforcements 40 are produced in hollow space of the mold, the lower top shell 8 of the centrifugal concrete mold 7 can be filled with concrete. Then, both mold halves 8 and 9 are fixedly connected at their longitudinal flanges 10 and 11, and after sufficient pretensioning of the pretensioning wires or pretensioning strands 4 extending in the longitudinal direction of the mold 7, the centrifugal process can start. It is performed in a conventional manner for such a time until the concrete is sufficiently rigidified and the finished pretensioned concrete body 1 can be removed from the centrifugal concrete mold 7.

For the removal from the mold, first the threaded anchor bolts 15 on the different intermediate anchors 12 are released, so that then the upper semi-shell 9 of the centrifugal concrete mold 7 is removed as shown in FIG. 9. Then, the intermediate anchors 12 located in the wall of the pretensioned concrete body 1 are released in the following manner. First, on each intermediate anchor 12 the fork-shaped projecting piece 17 connected with the abutment body 13 is released by the threaded bolt 24 from the mast wall as shown in FIG. 9. After the removal of the fork-shaped projecting piece 17 from the wall of the pretensioned concrete body 1, the associated pretensioning wire 5 can be cut through by a welding burner or another suitable separating device, and as shown in FIGS. 9 and 10, the abutment body 13 can be released from the wall of the pretensioned concrete body 1. After this, the thus formed recess 28 can be filled with concrete.

It will be understood that each of the elements described above, or two or more together, may also find a useful application in other types of constructions differing from the types described above.

While the invention has been illustrated and described as embodied in an intermediate anchor for a centrifugal concrete mold composed of tubular semi-shells with end tensioning heads, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An intermediate anchor for a centrifugal concrete mold composed of tubular semi-shells with end tensioning heads for producing conically extending tubular pretensioned concrete bodies with some pretensioning elements extending over a whole length of the pretensioned concrete body between the heads and other pretensioning elements extending from a foot-side clamping head to at least one intermediate location between opposite ends of said mold corresponding to locations of intermediate anchors extending over an inner periphery of the centrifugal concrete mold, the intermediate anchor comprising an abutment body for an end of an anchoring element mounted on an end of a pretensioning element, said abutment body being supportable on an inner side of a wall of the centrifugal concrete mold and mountable on the inner side of said wall; means for mounting said abutment body on the inner side of the wall of the centrifugal concrete mold and including at least one anchor bolt extendable through the wall of the centrifugal concrete mold in a sealed manner, said abutment body having a conical recess extending transversely to said anchor bolt for receiving the anchoring element of the pretensioning element; a fork-shaped projecting wedge piece releasably mounted on the abutment body and engaging the pretensioning element in a fork-shaped manner near the anchoring element, said projecting piece being releasable of the pretensioned concrete body after removal of the concrete body from the centrifugal concrete mold and before removal of the abutment body from the concrete body so as to release a portion of the pretensioning element near the anchoring element for separating by a separating device to release the abutment body from the concrete body.

2. An intermediate anchor as defined in claim 1, wherein said recess of said abutment body for the anchoring element conically decreases toward the wedge piece, and said anchor comprises the anchoring element formed as a clamp with at least two wedge-shaped round clamping jaws for clamping the pretensioning element.

3. An intermediate anchor as defined in claim 2; and further comprising a pressure spring arranged to press said round clamping jaws into said recess so that the pretensioning element is blockingly clamped between the round clamping jaws without a pulling stress.

4. An intermediate anchor as defined in claim 3; and further comprising means for closing said conical recess of said abutment body and including a closure screw, said closure screw being formed as an abutment for said pressure spring.

5. An intermediate anchor as defined in claim 1, wherein said abutment body has an upper edge recess, said projecting piece having an L-shaped holding flange releasably mounted in said upper edge recess; and further comprising a threaded bolt which releasably mounts said L-shaped holding flange in said upper edge recess.

6. An intermediate anchor as defined in claim 5, wherein said threaded bolt extends parallel to said anchor bolt and is arranged in a sinking manner on said projecting piece.

7. An intermediate anchor as defined in claim 6, wherein said abutment body has an opening for said threaded bolt, and said holding flange of said projecting piece being provided with a threaded opening extending parallel to but not aligned with said anchor body opening for screwing in of said threaded bolt to remove said projecting piece from said abutment body.

8. An intermediate anchor as defined in claim 7, wherein said abutment body has a projection, said threaded opening in which said threaded bolt is screwed in extends to said projection of said abutment body.

9. An intermediate anchor as defined in claim 1, wherein said anchor bolt is formed as a screw anchor bolt; and further comprising a plurality of mounting bushes mountable on the centrifugal concrete mold for mounting the intermediate anchor by said screw anchor bolts, said mounting bushes being sealingly connectable with a wall of the centrifugal concrete mold.

10. An intermediate anchor-as defined in claim 9, wherein said mounting bushes and said screw anchor bolts are provided with matching interengaging conical supporting surfaces.

11. An intermediate anchor as defined in claim 9, wherein each of said mounting bushes has an opening for said screw anchor bolt; and further comprising a closure cover for closing said mounting bush and provided with a plug insertable into said opening of said mounting bush.

12. An intermediate anchor as defined in claim 11, wherein said opening for said screw bolt of said mounting bush and said plug of said closure cover are conical.

13. An intermediate anchor as defined in claim 11, wherein each of said mounting bushes has a ring-shaped peripheral groove, said closure cover engaging said mounting bush; and further comprising a screw thread pin extending radially inwardly from an edge of said closure cover into said peripheral groove.

* * * * *